US012798839B2

(12) United States Patent
Berroa García

(10) Patent No.: US 12,798,839 B2
(45) Date of Patent: Nov. 17, 2026

(54) LIGHTWEIGHT ARTICULATED CAP

(71) Applicant: BETAPACK, S.A.U., Irun (ES)

(72) Inventor: Francisco Javier Berroa García, Irun (ES)

(73) Assignee: BETAPACK, S.A.U., Irun (ES)

( * ) Notice: Subject to any disclaimer, the term of this patent is extended or adjusted under 35 U.S.C. 154(b) by 0 days.

(21) Appl. No.: 19/051,861

(22) Filed: Feb. 12, 2025

(65) Prior Publication Data

US 2025/0256895 A1 Aug. 14, 2025

(30) Foreign Application Priority Data

Feb. 12, 2024 (EP) ..... 24382138

(51) Int. Cl.
*B65D 47/08* (2006.01)
*B65D 41/34* (2006.01)

(52) U.S. Cl.
CPC ..... *B65D 47/0838* (2013.01); *B65D 41/3428* (2013.01)

(58) Field of Classification Search
CPC B65D 55/16; B65D 2401/30; B65D 41/3447; B65D 47/08; B65D 41/34; B65D 43/169; B65D 47/0814
USPC ..... 215/235
See application file for complete search history.

(56) References Cited

U.S. PATENT DOCUMENTS

| | | | | |
|---|---|---|---|---|
| 9,415,909 | B2 * | 8/2016 | Druitt | B65D 47/0809 |
| 2018/0086510 | A1 * | 3/2018 | Berroa Garcia | B65D 41/46 |
| 2021/0122532 | A1 | 4/2021 | Dreyer et al. | |

FOREIGN PATENT DOCUMENTS

| | | | | |
|---|---|---|---|---|
| EP | 3305680 | A1 | 4/2018 | |
| JP | 2012-180100 | A | 9/2012 | |
| JP | 2022-086921 | A | 6/2022 | |
| WO | 2006/013276 | A1 | 2/2006 | |
| WO | WO-2021099310 | A2 * | 5/2021 | B65D 41/3409 |

* cited by examiner

*Primary Examiner* — Chun Hoi Cheung
*Assistant Examiner* — Sanjidul Islam
(74) *Attorney, Agent, or Firm* — ArentFox Schiff LLP; Daniel W. Clarke

(57) ABSTRACT

Lightweight articulated cap, attachable to the neck finish of a container, comprising:

a lower ring (1);

a folding upper lid (2), which in turn comprised:

a horizontal upper wall (4), with a thickness (A) and a radius (C); and a peripheral skirt (5), intended to surround the neck finish of the container when the lid (2) is in the closed position; and a hinge element (3) for articulated linking of the lid (2) with the ring (1), which comprises two elastic sheets (13) parallel and separated from each other by a minimum distance (D), and wherein each of the elastic sheets (13) has a width (B). The peripheral skirt (5) has at least one recess in the form of a perimeter notch (9) and the ring (1) has at least one perimeter groove (12).

8 Claims, 4 Drawing Sheets

LIGHTWEIGHT ARTICULATED CAP

OBJECT OF THE INVENTION

The present invention falls within the technical field of caps with discharge elements, more specifically those provided with articulated closures, and refers in particular to an articulated cap with a lower weight than other similar caps and in whose production it is also used a smaller amount of materials.

BACKGROUND OF THE INVENTION

In the packaging industry there is a need to obtain lightweight, functional and reliable products, using the minimum possible amount of materials. This is due first of all to economic needs, both in manufacturing, transportation, and storage, as well as current trends in reducing plastic consumption. Within the different types of packaging, much attention has been paid to elements such as bottles, packaging or boxes and it has been achieved products that are lightweight and function correctly.

However, in the case of closure elements, such as closure caps for liquid containers, such efforts are not so common. One of the few examples can be found in European patent EP1765685, which describes a flexible plastic or metalloplastic tube that has a dispensing head and a cylindrical skirt with a diameter greater than 40 mm. Said tube is characterized in that said cylindrical skirt is less than 0.40 mm thick and comprises at least 70% by weight of high-density polyethylene (HDPE), with a specific mass between 0.935 g/cm3 and 0.97 g/cm3, and comprising not more than 30% by weight of low density polyethylene (LDPE), of specific mass ranging between 0.86 g/cm3 and 0.93 g/cm3 and of which more than 50% is a linear LDPE.

JP2012180100 seeks to provide a lightweight hinge cap in which the amount of resin usage constituting the lid is drastically reduced without impairing the capping property and liquid tightness property. To this end, an inner ring is formed in close contact with the inner surface of a pouring nozzle on an upper surface of a top cover, a mating protuberance that engages with a portion of the outer surface of the tip of the pouring nozzle to securing the top cover of a lid body formed on the inner surface of an annular side wall. A hinge part and the annular side wall corresponding to the hinge part are connected with a flat part, the length of the annular side wall is formed shorter on the side of the pouring direction than on the side of the hinge part, at least two ribs having the same height as the flat portion are formed around the pouring spout of an upper plate portion of the lid body, and together with the flat portion the ribs support a load on the finish.

Finally, JP2022086921 provides a hinged lid, including a lid body attached to a neck finish of a container body, and a top lid having a peripheral lid wall hanging from a peripheral end of a top plate covering an upper wall of the lid body, wherein a lower end of the peripheral wall of the lid is rotatably connected to the lid body through a hinge portion, wherein a lightening region L is formed in a part of the top tab. At least a pair of main lightening regions located on both sides of the hinge portion and extending from the proximity of the hinge portion through the top plate to the side opposite the hinge portion, are provided as the lightening region L.

In general, these are complex solutions that do not ensure the robustness and functionality of the resulting cap.

On the other hand, EP3305680, owned by this same applicant, describes a cap for containers comprising a cylindrical body formed by the articulated linking of two superimposed pieces, a lower piece provided with gripping means for retention in the neck finish of the container, and an upper piece provided with an upper base joined to a perimeter wall, where said perimeter wall comprises a visor to allow the opening of the cap, wherein said visor comprises a fin arranged transversely thereto and in correspondence with a complementary notch provided on the upper edge of the lower piece, wherein said fin comprises on an inner surface a cord arranged transversely to the axial axis of the cap to grip the upper piece to the neck finish of the container.

In short, there is a need to have a lightweight articulated cap with a simple and robust construction, allowing the minimum amount of plastic to be used without compromising its functionality.

DESCRIPTION OF THE INVENTION

The object of the invention consists of a lightweight articulated cap, which presents a series of structural modifications that allow reducing the volume of plastic material used for its production without negatively affecting its resistance or functionality. To this end, the thicknesses and other dimensions of its elements are mainly modified, and a series of structural reductions are incorporated in the form of grooves, recesses and the like, which contribute to reducing the total volume of the cap, and consequently reduce both its final weight and the amount of plastic required for its manufacture.

The cap comprises a lower ring, intended to be retained in the neck finish of the container, an upper lid, intended to cover the pouring hole of the container to seal it, and an articulation element or hinge that articulately connects the lid with the ring.

The cap comprises a roof or horizontal upper wall, intended to be arranged substantially orthogonal to the X axis in front of the neck finish hole when said lid is in the closed position. The lid further comprises a peripheral skirt intended to surround the neck finish of the container in the closed position.

The ring remains axially linked to the neck finish of the container and is connected to the lid through the articulation element, and also by frangible bridges before the first opening of the lid.

For the plastic reduction to be significant, action must first be taken on the thickness of the horizontal wall of the lid. However, a reduction in the thickness of the horizontal wall may cause the articulation element to malfunction, since said horizontal wall may tend to collapse on itself.

To correct this problem, it is necessary to work simultaneously with up to three elements of the cap that interact with each other: the thickness of the horizontal wall, the flexibility and width of the articulation element, and the dimensions of a part of the horizontal wall that extends beyond the peripheral skirt and forms a canopy.

In fact, the more the thickness of the horizontal wall decreases, the more it becomes necessary to act with the canopy and with the flexibility of the hinge. It has been experimentally shown that if the thickness of the roof decreases by 15%+/−10%, the rigidity of the hinge should also decrease by 20%+/−10% without changing the characteristics of the canopy. On the other hand, if the thickness of the roof decreases by 30%+/−10%, then the rigidity of the hinge must also decrease by 20%+/−10%, and in that case the canopy must be reduced by 10%+/−5%.

Furthermore, by varying the thickness of the horizontal wall the width of the hinge must also vary proportionally. If the thickness of the wall is referred to as "A", and the width of the hinge as "B", it is verified that B (mm)=(3.75±0.25)×A (mm).

As it will be seen later, in the preferred embodiment of the cap, the articulation element is made up of two parallel elastic sheets that run between the lid and the ring. The separation between both sheets is referred to as "D", and the radius of the upper horizontal wall is known as "C", which, as usual, has a circular geometry in plan.

In the cap of the invention, the following relationships are also verified: C (mm)=(1.8±0.25)×D (mm); C (mm)=(4.6±0.1)×B (mm).

In addition to these elements, it has been decided to incorporate at least one notch as a recess in the lower perimeter edge of the peripheral skirt of the lid. Said notch represents a first contribution to lightening the weight of the cap, as well as a first reduction in the amount of plastic used in the production of said cap.

Likewise, at least one perimeter groove is added to the external face of the ring. Said groove represents a second contribution to lightening the weight of the cap, as well as a second reduction in the amount of plastic used in the production of said cap.

With all these elements, a lightweight articulated cap is achieved, in which a minimum amount of plastic is used, and which does not affect either its structural resistance or its correct functioning. In this way, a cap is obtained that manages to overcome all the objections of the current state of the art in a simple and economical way.

DESCRIPTION OF THE DRAWINGS

To complement the description being made and in order to help a better understanding of the characteristics of the invention, in accordance with a preferred example of practical embodiment thereof, a set of drawings is attached as an integral part of said description, wherein, for illustrative and non-limiting purposes, the following has been represented.

PREFERRED EMBODIMENT OF THE INVENTION

Below, with the help of the aforementioned figures, a detailed explanation of an example of a preferred embodiment of the object of the present invention is provided. In the description, when reference is made to the X axis, it must be understood that this corresponds to a capping device axis intended to be positioned orthogonally to the hole plane to be plugged when the capping device is in closed position and plugs said hole. The X axis thus corresponds to the axis of rotation of the cap of the capping device when it is screwed into the neck finish of the container. By convention, the "radial" orientation is directed orthogonally to the X axis. The terms "external" are used to define the relative position of one element with respect to another, by reference to this mode of internal as opposed to an external element located radially on the periphery. The terms "upper" and "lower" are used to define the relative position of one element with respect to another by reference to a position in which the neck finish hole is oriented upward and the cap is in the closed position on the neck finish of the container, an element intended to be placed in a lower position, being referred to as lower, and an element intended to be placed in a higher position being referred to as upper.

The lightweight articulated cap described is intended to be attached to the neck finish of a container that has a coupling collar in correspondence with a liquid pouring hole. The cap, shown in FIGS. 1-4, is made up of a lower ring (1), intended to be retained in the neck finish of the container, an upper lid (2), intended to cover the pouring hole of the container to seal it, and a hinge element (3) that articulately connects the lid (2) with the ring (1).

Figure 7:
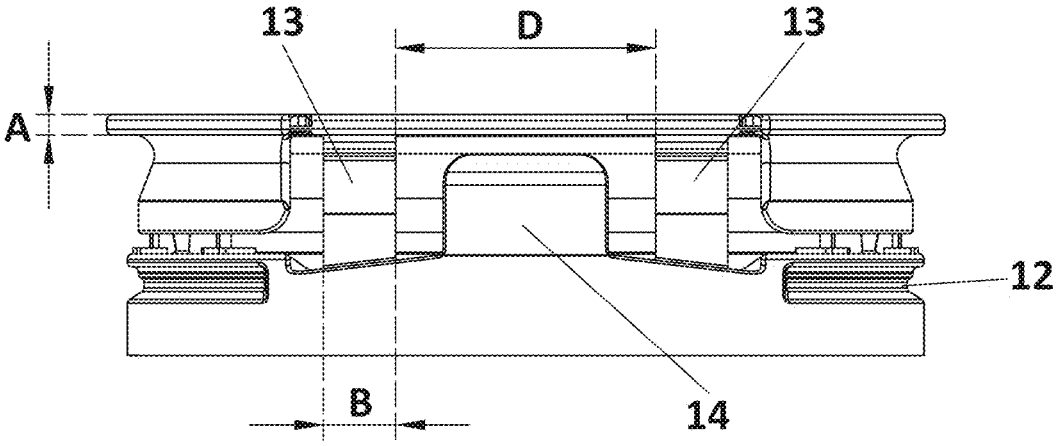
FIG. 7. Shows a rear view of the cap.
Figure 8:
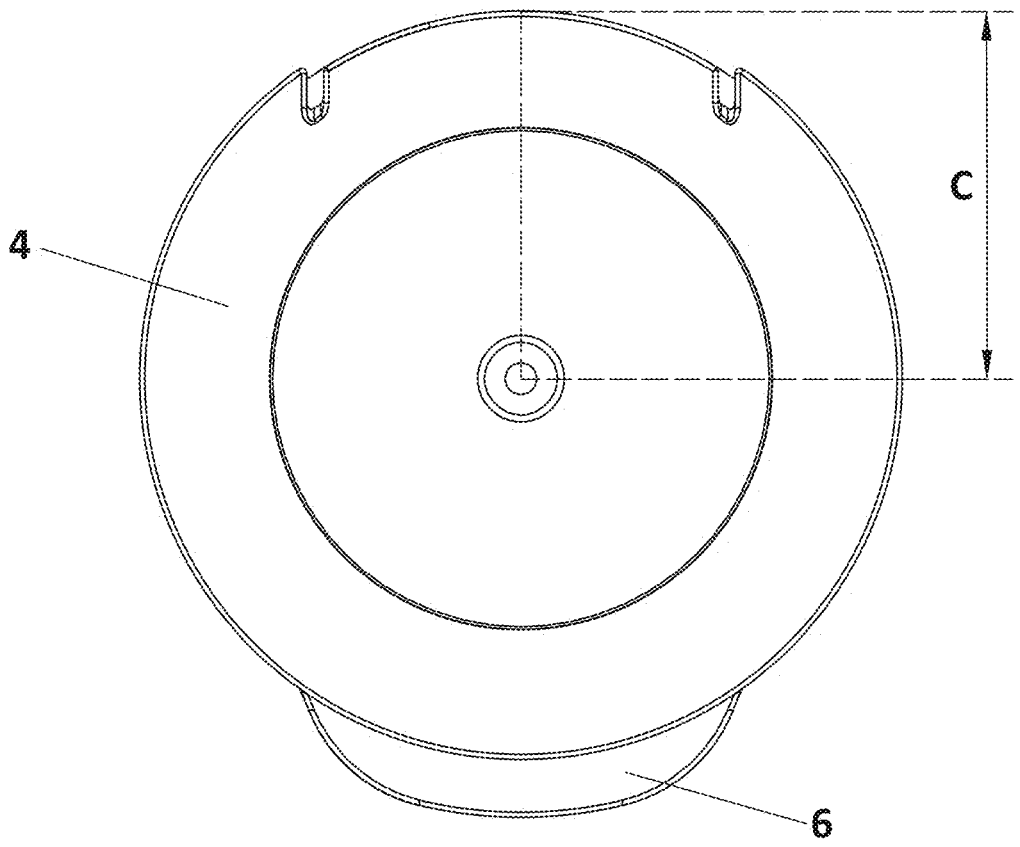
FIG. 8. Shows a top plan view of the cap.

The lid (2) comprises a horizontal upper wall (4), intended to be arranged substantially orthogonal to the X axis in front of the neck finish hole when said lid (2) is in the closed position. The upper wall (4) has a thickness (A) reduced to a minimum such that it ensures its structural resistance without affecting the functionality of the cap, as indicated in FIG. 7. Said upper wall (4), which as usual has the round geometry in plan seen in FIG. 8, has a radius (C).

The lid (2) further comprises a peripheral skirt (5), intended to surround the neck finish of the container when said lid (2) is in the closed position. The peripheral skirt (5) extends downward, perpendicular to the upper wall (4), from the external periphery of said upper wall (4).

The lid (2) is movable between a closed position and an open position. In the open position, the lid (2) is no longer attached to the neck finish of the container. It is thus capable of being folded into the open folded position, in which the lid (2) is removed from the hole so that it does not hinder the pouring of the contents of the container.

The lid (2) also comprises an internal skirt that extends perpendicularly downward from an internal face of the upper wall (4) and is configured to be inserted within the neck finish hole. The lid (2) further comprises an annular lip, which extends, from an internal face of the upper wall (4), radially between the internal skirt and the external peripheral skirt (5). The inner skirt and the annular lip are sized so that, when the lid (2) is in the closed position, on the neck finish of the container, the inner skirt is in contact against the inner face of the neck finish while the annular lip is in contact against the outside of the neck finish. In this way, the internal skirt and the annular lip ensure the tightness of the closure.

The lid (2) also includes a transverse visor (6), which extends from the peripheral skirt (5) to allow manual opening and closing. The visor (6) further comprises a transverse fin (7), which cooperates with a notch (8) defined on an upper edge of the ring (1). The visor (6) is arranged diametrically opposite the hinge element (3).

The peripheral skirt (5) has at least one notch (9) defined on its lower perimeter edge as a recess. Said notch (9) represents a first contribution to lightening the weight of the cap, as well as a first reduction in the amount of plastic used in the production of said cap.

In the preferred embodiment shown in these figures, the cap comprises two notches (9), which extend respectively from the vicinity of the visor (6) to the vicinity of the hinge element (3).

The ring (1) is, before the first opening of the container, connected to the lid (2) by frangible bridges (10) intended to break during the first opening of the lid (2). These frangible bridges (10) thus constitute inviolability seals and temporarily connect the upper edge of the ring (1) and the lower edge of the peripheral skirt (5).

The ring (1) remains axially linked to the neck finish of the container, and at the same time it can rotate with respect to it around the X axis. The ring (1) is connected to the lid (2) through the hinge element (3), and also by the frangible bridges (10) before the first opening of the lid (2).

Figure 1:
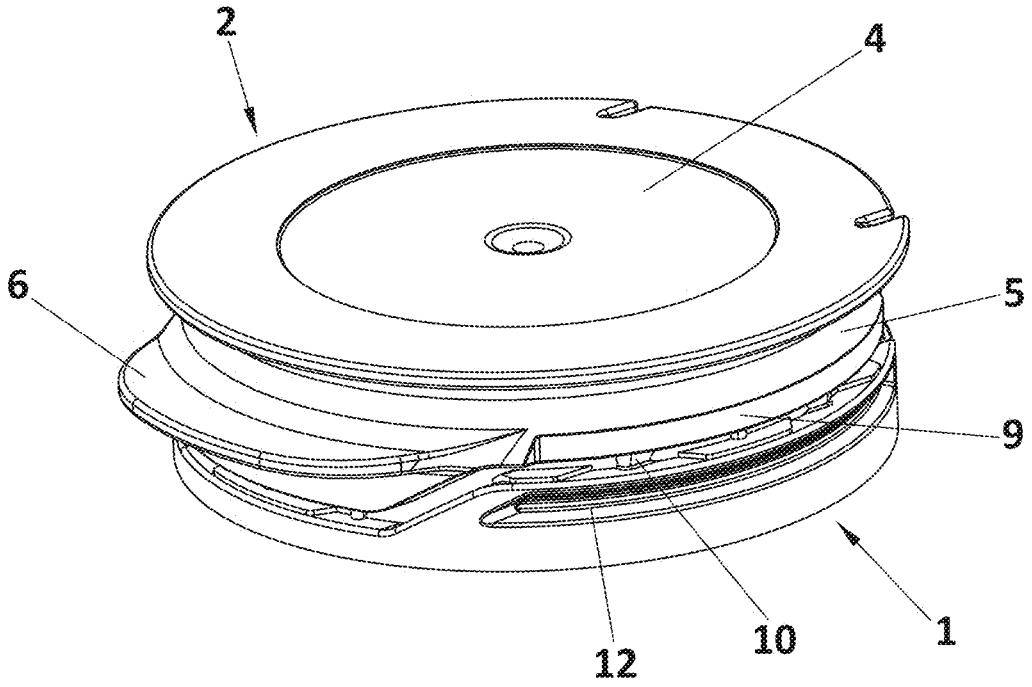
FIG. 1. Shows a front top perspective view of the lightweight articulated cap.
Figure 2:
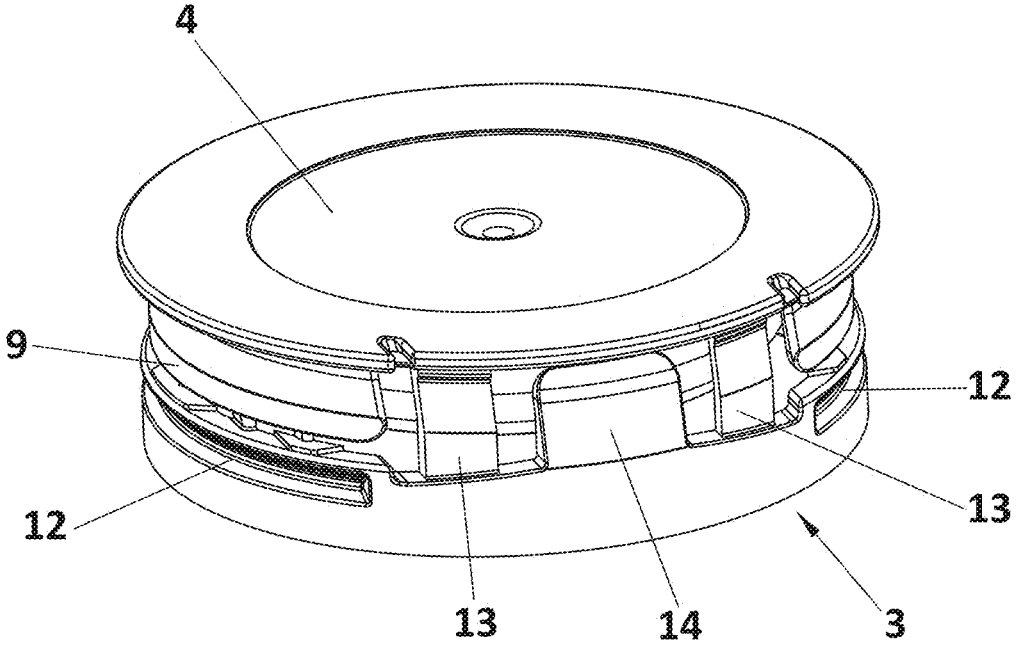
FIG. 2. Shows a rear top perspective view of the cap.
Figure 3:
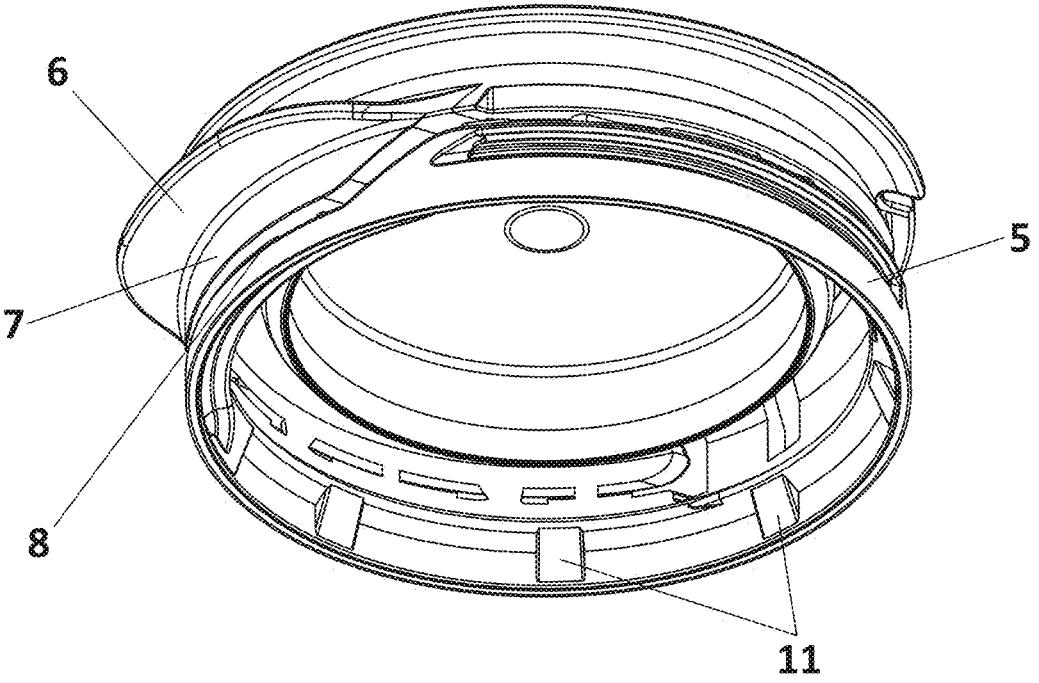
FIG. 3. Shows a lower front perspective view of the cap.
Figure 4:
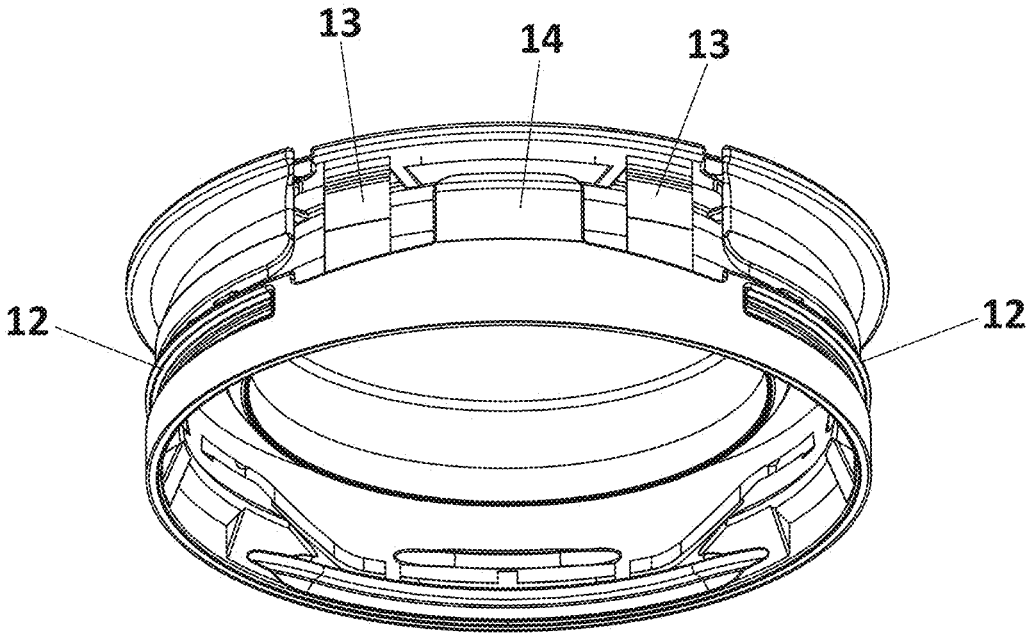
FIG. 4. Shows a lower rear perspective view of the cap.
Figure 5:
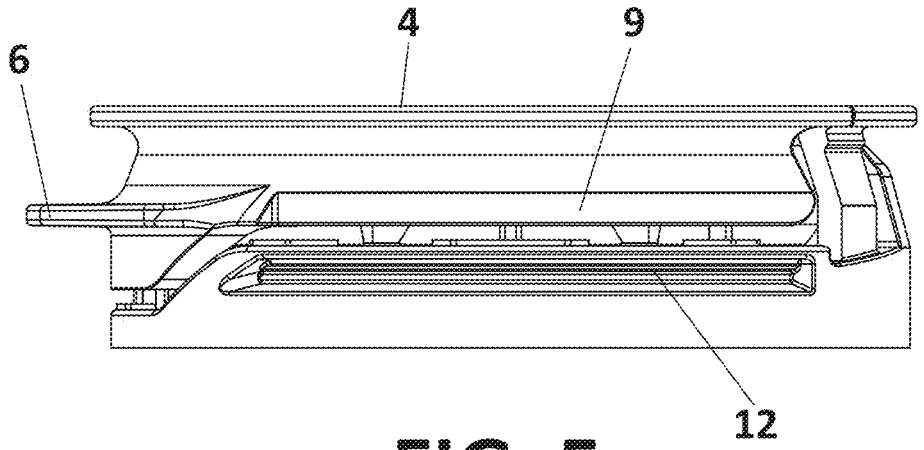
FIG. 5. Shows a right-side view of the cap.
Figure 6:
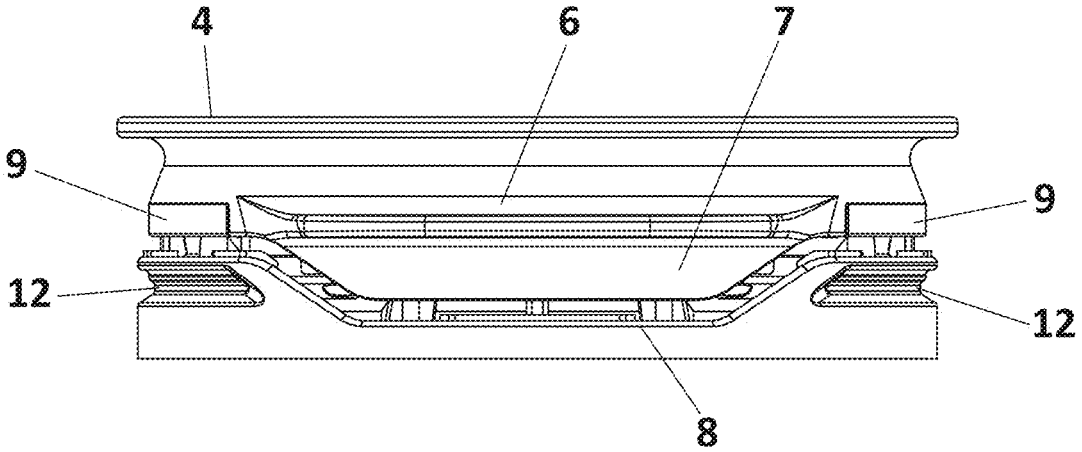
FIG. 6. Shows a front view of the cap.

The lower ring (1) includes retaining elements (11), as it can be seen in FIGS. 3 and 4, allowing said ring (1) to be retained on the neck finish of the container. In this preferred embodiment, the retaining elements (11) are protuberances that protrude radially inward from an internal face of the ring (1). The protuberances have a radial dimension increasing from bottom to top, that is, in the direction of the upper edge of the ring (1).

The ring (1) has on its external face at least one perimeter groove (12). In this preferred embodiment, said groove (12) is located near the upper edge of the ring (1), and represents a second contribution to lightening the weight of the cap, as well as a second reduction in the amount of plastic used in the production of said cap.

In the preferred embodiment shown in these figures, the ring (1) comprises two grooves (12), which extend respectively from the vicinity of the notch (8) to the vicinity of the hinge element (3).

The hinge member (3) is configured to allow the lid (2) to swing between the released position and the folded open position. In the embodiment shown, the hinge element (3) includes two parallel elastic sheets (13) that connect the lid (2), more particularly the peripheral skirt (5), to the ring (1). The elastic sheets (13) of the hinge element (3) are separated from each other by a minimum distance (D), and each of the elastic sheets (13) has a width (B), as illustrated in FIG. 7.

Firstly, the following relationship is verified between the thickness (A) of the upper wall (4) and said width (B) of the elastic sheets (13), ensuring the correct functionality of the cap: $(B)=(3.75\pm0.25)\times(A)$, with 0.25 being a tolerance factor. That is, the width (B) of each elastic sheet (13) has dimensions included in a range comprising 3.5 to 4 times the thickness (A) of the upper wall (4).

Secondly, the following relationship is verified between the radius (C) of the upper wall (4) of the lid (2) and the distance (D) of separation between the two elastic sheets (13), ensuring the correct functionality of the cap: $(C)=(1.8\pm0.25)\times(D)$, with 0.25 being a tolerance factor. That is, the radius (C) of the upper wall (4) has dimensions included in a range comprising 1.55 to 2.05 times the distance (D) of separation between the two elastic sheets (13).

Thirdly, the following relationship is verified between the radius (C) of the upper wall (4) of the lid (2) and the width (B) of the elastic sheets (13), ensuring the correct functionality of the cap: $(C)=(4.6\pm0.1)\times(B)$, with 0.1 being a tolerance factor. That is, the radius (C) of the upper wall (4) has dimensions included in a range comprising 4.5 to 4.7 times the width (B) of each of the elastic sheets (13).

The lightweight hinged cap additionally comprises a locking device configured to lock the lid (2) in the folded open position. The locking device comprises a flexible tongue (14), arranged between the two elastic sheets (13).

Preferably, the closure cap is produced by molding in a single piece of synthetic material, such as polyethylene, and advantageously in high-density polyethylene.

What is claimed is:

1. Lightweight articulated cap for a container with a hooking collar in correspondence with a liquid pouring hole, comprising:

a lower ring, intended to be retained in a neck finish of the container;

an upper lid that can be folded between an open position and a closed position, which in turn comprises:

a horizontal upper wall, with a thickness and a radius, intended to be arranged substantially orthogonal to the liquid poring hole when the lid is in the closed position; and a peripheral skirt, intended to surround the neck finish of the container when the lid is in the closed position; and a hinge element for articulated linking of the lid with the ring, which comprises two elastic sheets parallel and separated from each other by a minimum distance, which extend between the peripheral skirt of the lid and an upper end of the ring, and where each of the elastic sheets has a width;

the cap being characterized in that:

the peripheral skirt has at least one recess in the form of a perimeter notch; and the ring has at least one perimeter groove;

wherein the width of each elastic sheet has dimensions included in a range that comprises 3.5 to 4 times the thickness of the upper wall;

wherein the radius of the upper wall has dimensions included in a range comprising 1.55 to 2.05 times the distance of separation between the two elastic sheets; and wherein the radius of the upper wall has dimensions included in a range comprising 4.5 to 4.7 times the width of each of the elastic sheets.

2. Lightweight articulated cap according to claim 1, wherein the peripheral skirt has two notches.

3. Lightweight articulated cap according to claim 1, wherein the ring has two grooves.

4. Lightweight articulated cap according to claim 1, wherein the lid additionally comprises a transverse visor, which extends from the peripheral skirt for manual opening and closing, wherein the visor further comprises a transverse fin that cooperates with a notch defined in an upper edge of the ring.

5. Lightweight articulated cap according to claim 1, that additionally comprises frangible bridges for temporary connection of an upper edge of the ring with a lower edge of the peripheral skirt.

6. Lightweight articulated cap according to claim 1, wherein the ring includes retaining elements configured to be placed on the neck finish of the container.

7. Lightweight articulated cap according to claim 1, that additionally comprises a locking device for locking the lid in the open position.

8. Lightweight articulated cap according to claim 7 wherein the locking device comprises a flexible tongue, arranged between the two elastic sheets.

* * * * *